US011688959B2

(12) United States Patent
Ruffini et al.

(10) Patent No.: US 11,688,959 B2
(45) Date of Patent: Jun. 27, 2023

(54) POSITIVE LOCK SEALED TERMINAL CONNECTOR

(71) Applicant: TE CONNECTIVITY SERVICES GMBH, Schaffhausen (CH)

(72) Inventors: Nicholas Paul Ruffini, Middletown, PA (US); Destin Shimmel, Middletown, PA (US)

(73) Assignee: TE Connectivity Solutions GmbH, Schaffhausen (CH)

( * ) Notice: Subject to any disclaimer, the term of this patent is extended or adjusted under 35 U.S.C. 154(b) by 0 days.

(21) Appl. No.: 17/399,631

(22) Filed: Aug. 11, 2021

(65) Prior Publication Data

US 2023/0046014 A1 Feb. 16, 2023

(51) Int. Cl.

| | |
|---|---|
| ***H01R 12/71*** | (2011.01) |
| ***H01R 12/70*** | (2011.01) |
| ***H01R 12/75*** | (2011.01) |

(52) U.S. Cl.

CPC ..... *H01R 12/7064* (2013.01); *H01R 12/7047* (2013.01); *H01R 12/7082* (2013.01); *H01R 12/718* (2013.01); *H01R 12/75* (2013.01)

(58) Field of Classification Search

CPC ..... H01R 12/7064; H01R 12/7011; H01R 12/7005; H01R 12/70; H01R 12/7047; H01R 12/7082; H01R 12/718; H01R 12/75; H01R 12/71; H01R 4/4836

USPC ..... 439/567

See application file for complete search history.

(56) References Cited

U.S. PATENT DOCUMENTS

| | | | | |
|---|---|---|---|---|
| 5,722,925 | A | 3/1998 | Kameyama et al. | |
| 7,347,708 | B1 * | 3/2008 | Huang | H01R 13/639 439/263 |
| 7,670,164 | B2 * | 3/2010 | Shiga | H01R 13/506 439/278 |
| 8,520,278 | B2 * | 8/2013 | Bovino | G02F 3/00 359/108 |
| 9,048,584 | B2 * | 6/2015 | Thackston | H01R 24/62 |
| 9,147,971 | B2 * | 9/2015 | Osada | H01R 13/641 |
| 9,160,089 | B2 * | 10/2015 | Shimoji | H01R 13/62 |

(Continued)

FOREIGN PATENT DOCUMENTS

GB 2 000 918 A 1/1979

OTHER PUBLICATIONS

European Search Report, dated Jan. 2, 2023, EP 22 18 9182, International Application No. 22189182.3-1201.

*Primary Examiner* — Harshad C Patel

(57) ABSTRACT

A connector for providing an electrical connection between at least one terminating mating terminal to a substrate. The connector includes a housing having at least one terminal receiving cavity. A receptacle terminal is positioned in the at least one terminal receiving cavity. The receptacle terminal has a latching projection which cooperates with the at least one mating terminal to retain the at least one mating terminal in electrical engagement with the receptacle terminal when the at least one mating terminal is fully inserted in the at least one terminal receiving cavity. A release mechanism is provided in the housing in line with the latching projection of the receptacle terminal, the release mechanism is configured to cooperate with the receptacle terminal to depress the latching projection when the at least one mating terminal is to be removed from the at least one terminal receiving cavity.

20 Claims, 5 Drawing Sheets

(56) References Cited

U.S. PATENT DOCUMENTS

| | | | | |
|---|---|---|---|---|
| 9,472,871 | B2 * | 10/2016 | Lin | H01R 4/4836 |
| 9,509,067 | B2 * | 11/2016 | Yamauchi | H01R 9/0518 |
| 9,543,682 | B2 * | 1/2017 | Jin | H01R 4/4836 |
| 9,548,574 | B2 * | 1/2017 | Hsu | H01R 13/7038 |
| 10,910,769 | B2 * | 2/2021 | Yoshida | H01R 13/633 |
| 2009/0275227 | A1 * | 11/2009 | Fujiwara | H01R 13/504 439/271 |
| 2015/0064524 | A1 | 3/2015 | Noh et al. | |
| 2018/0337491 | A1 * | 11/2018 | Miyamura | H01R 13/4223 |

* cited by examiner

POSITIVE LOCK SEALED TERMINAL CONNECTOR

FIELD OF THE INVENTION

The invention is directed to a connector which provides an electrical connection with mating terminals without the need for additional tooling. In particular, the invention is directed to a sealed connector with receptacle terminals which mate with ring tongue terminals.

BACKGROUND OF THE INVENTION

Ring tongue terminal lugs are used in many applications to provide an electrical connector between a conductor or wire and a ground on a substrate or other device. However, the proper termination of the terminal lugs to the receptacle terminals often requires the use of one or more tools. The use of tools may be difficult in various application in which the connectors are located in confined or hard to access spaces.

It would, therefore, be beneficial to provide a connector which overcomes the issues associated with known terminations of ring tongue terminal lugs. In particular, it would be beneficial to provide a connector which allows for the termination of ring tongue terminal lugs to the connector without the need for additional tooling.

SUMMARY OF THE INVENTION

The following provides a summary of certain illustrative embodiments of the present invention. This summary is not an extensive overview and is not intended to identify key or critical aspects or elements of the present invention or to delineate its scope.

An embodiment is directed to a connector for providing an electrical connection between at least one terminating mating terminal to a substrate. The connector includes a housing having at least one terminal receiving cavity. A receptacle terminal is positioned in the at least one terminal receiving cavity. The receptacle terminal has a latching projection which cooperates with the at least one mating terminal to retain the at least one mating terminal in electrical engagement with the receptacle terminal when the at least one mating terminal is fully inserted in the at least one terminal receiving cavity. A release mechanism is provided in the housing in line with the latching projection of the receptacle terminal, the release mechanism is configured to cooperate with the receptacle terminal to depress the latching projection when the at least one mating terminal is to be removed from the at least one terminal receiving cavity.

An embodiment is directed to a connector for providing an electrical connection between at least one terminating ring tongue terminal lug to a substrate. The connector includes a housing having at least one terminal receiving cavity. A receptacle terminal is positioned in the at least one terminal receiving cavity. The receptacle terminal has a spring arm with a latching projection. The latching projection has a locking shoulder. The latching projection and the locking shoulder cooperate with the at least one ring tongue terminal to retain the at least one ring tongue terminal in electrical engagement with the receptacle terminal when the at least one ring tongue terminal is fully inserted in the at least one terminal receiving cavity. The spring arm has a release projection provided at a free end. A release mechanism is provided in the housing in-line with the release projection of the latching projection of the receptacle terminal. The release mechanism is configured to cooperate with the release projection of the latching projection of the receptacle terminal to depress the latching projection when the at least one ring tongue terminal is to be removed from the at least one terminal receiving cavity.

Additional features and aspects of the present invention will become apparent to those of ordinary skill in the art upon reading and understanding the following detailed description of the illustrative embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more illustrative embodiments of the invention and, together with the general description given above and detailed description given below, serve to explain the principles of the invention, and wherein.

DETAILED DESCRIPTION OF THE INVENTION

Figure 1:
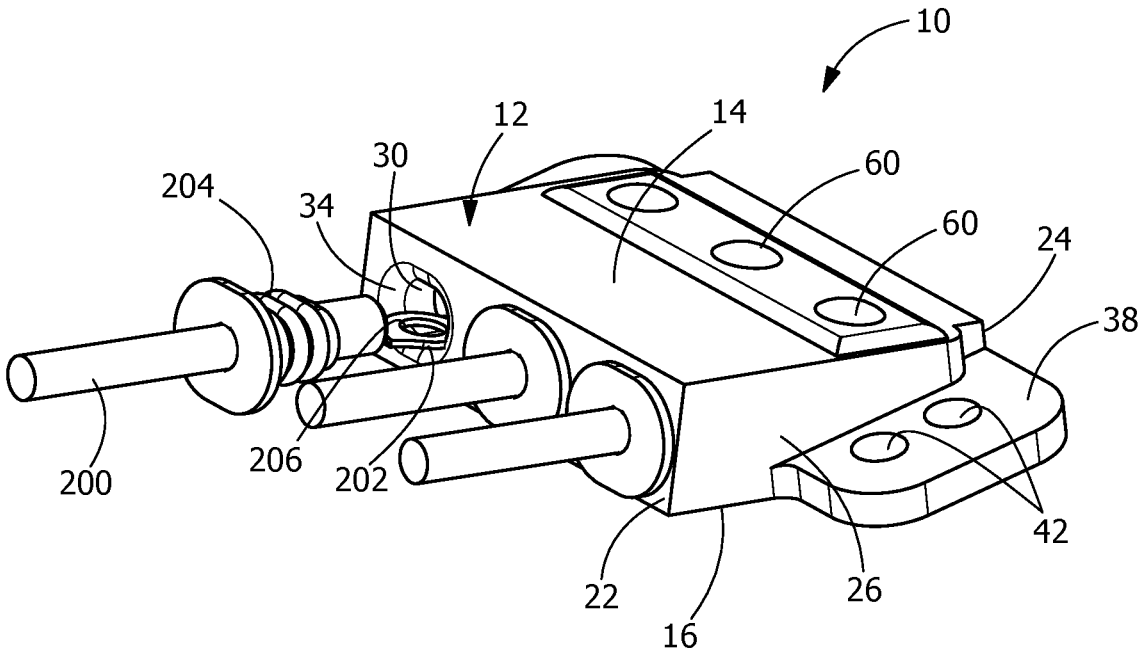
FIG. 1 is a top perspective view of an illustrative connector of the present invention, with two crimped wire terminals with wire seals fully inserted into terminal receiving passages of the connector, and a third connector shown partially inserted into a respective terminal receiving passage.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Illustrative embodiments of the present invention are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

Figure 2:
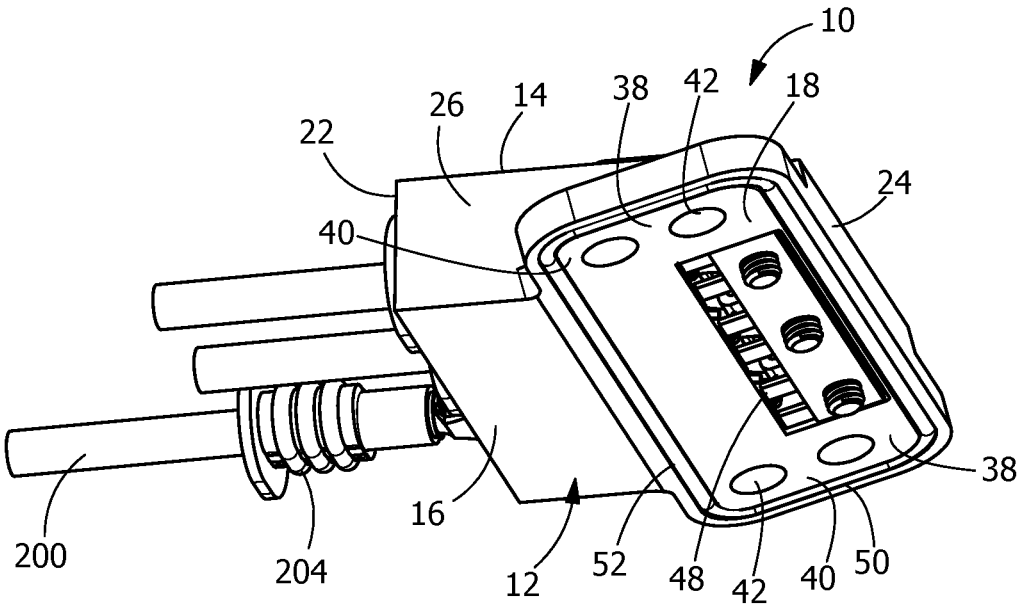
FIG. 2 is a bottom perspective view of the illustrative connector of FIG. 1.

An illustrative embodiment of a connector 10 according to the present invention, is shown in FIGS. 1 and 2. The connector 10 has housing 12 with a first or top surface 14 and a second or bottom surface 16. The bottom surface 16 has a mounting portion 18 for mounting to a substrate (not shown), such as, but not limited to a printed circuit board.

The housing 12 has a front surface 22, a rear surface 24 and side surfaces 26. In the embodiment shown, the front surface 22 is essentially perpendicular to the top surface 14 and the bottom surface 16. However, other configurations may be used.

In the illustrative embodiment shown, three terminal receiving openings 30 extend through the front surface 22. The terminal receiving openings 30 extend to a terminal receiving cavity 32. While three terminal receiving openings 30 are provided, other numbers and configurations of the terminal receiving openings 30 may be provided. Sloped or radiused surfaces 34 extend from the terminal receiving openings 30 to the terminal receiving cavity 32. The sloped or radiused surfaces 34 act as lead-in surfaces.

Mounting flanges or projections 38 extend from the side surfaces 26. The mounting flanges 38 have bottom surfaces 40 (FIG. 2) which are coplanar with the mounting portion 18 of the bottom surface 16 of the housing 12. Mounting openings 42 extend through the mounting flanges 38. The mounting openings 42 are configured to receive mounting hardware (not shown) to secure the housing 12 to a substrate (not shown).

In the illustrative embodiment, each of the terminal receiving openings 30 has a circular or oval configuration, however, other configurations may be used. The terminal receiving cavity 32 has a wire receiving portion 44 and a receptacle receiving portion 46. The receptacle receiving portion 46 has a smaller diameter than the wire receiving portion 44.

A contact strip receiving opening 48 extends through the mounting portion 18 of the bottom surface 16 of the housing 12. The contact strip receiving opening 48 extends to each of the terminal receiving cavity 32.

Figure 4:
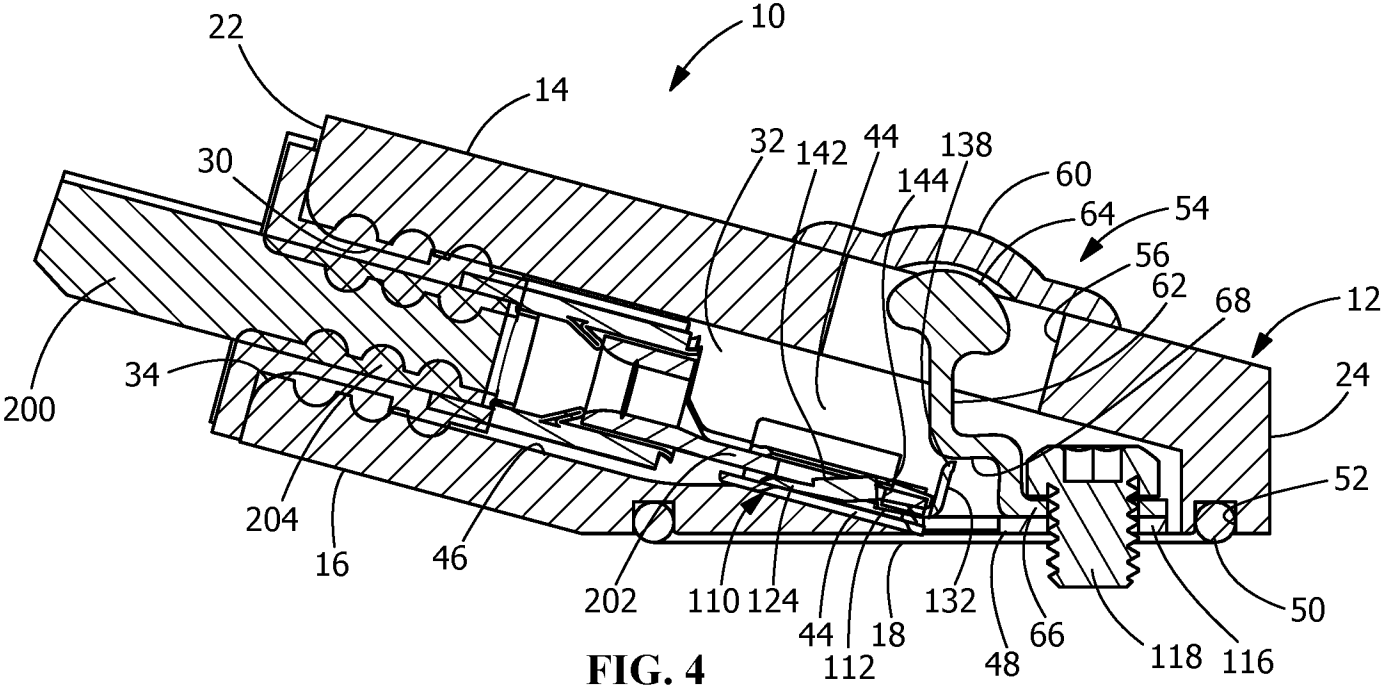
FIG. 4 is an enlarged cross-sectional view taken along line 4-4 of FIG. showing the crimped wire terminal fully mated with a receptacle terminal of the connector, a release button is shown in a disengaged position.
Figure 5:
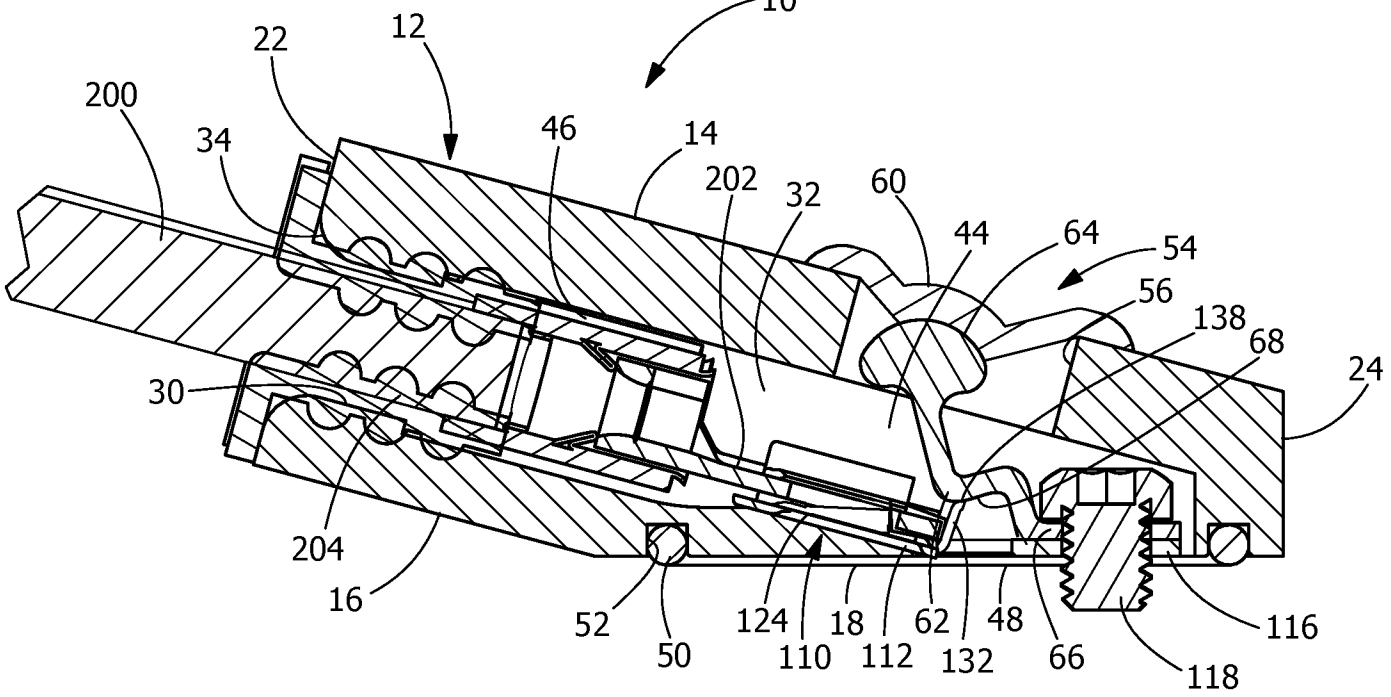
FIG. 5 is an enlarged cross-sectional similar to that of FIG. 4, showing the release button in an engaged position.

As shown in FIGS. 2, 4 and 5, a gasket 50 extends about the periphery of the mounting portion 18 of the bottom surface 16 of the housing 12. The gasket 50 is positioned in a gasket receiving cavity 52. The gasket 50 is made of a deformable material, such as, but not limited to rubber. The gasket 50 cooperates with the substrate to provide a seal between the substrate and the connector 10 when the connector 10 is mated to the substrate.

As shown in FIGS. 4 and 5, latch release mechanisms or assemblies 54 are proximate to and extend through latch release assembly openings 56 provided in the top surface 14 of the housing 12. In the illustrative embodiment shown, the latch release assembly openings 56 and the latch release assemblies 54 are positioned in line with the terminal receiving cavity 32. The latch release assemblies 54 have operator engagement members or membranes 60 and receptacle terminal engagement members 62. In the illustrative embodiment shown, the membrane 60 extends across the entire terminal receiving cavity 32. However, in other embodiments, individual membrane engagement members 60 may be provided.

The terminal engagement members 62 have membrane engagement portions 64 at one end and securing portions 66 at the opposite end. Terminal engagement surfaces 68 are provided between the membrane engagement portions 64 and the securing portions 66.

Figure 3:
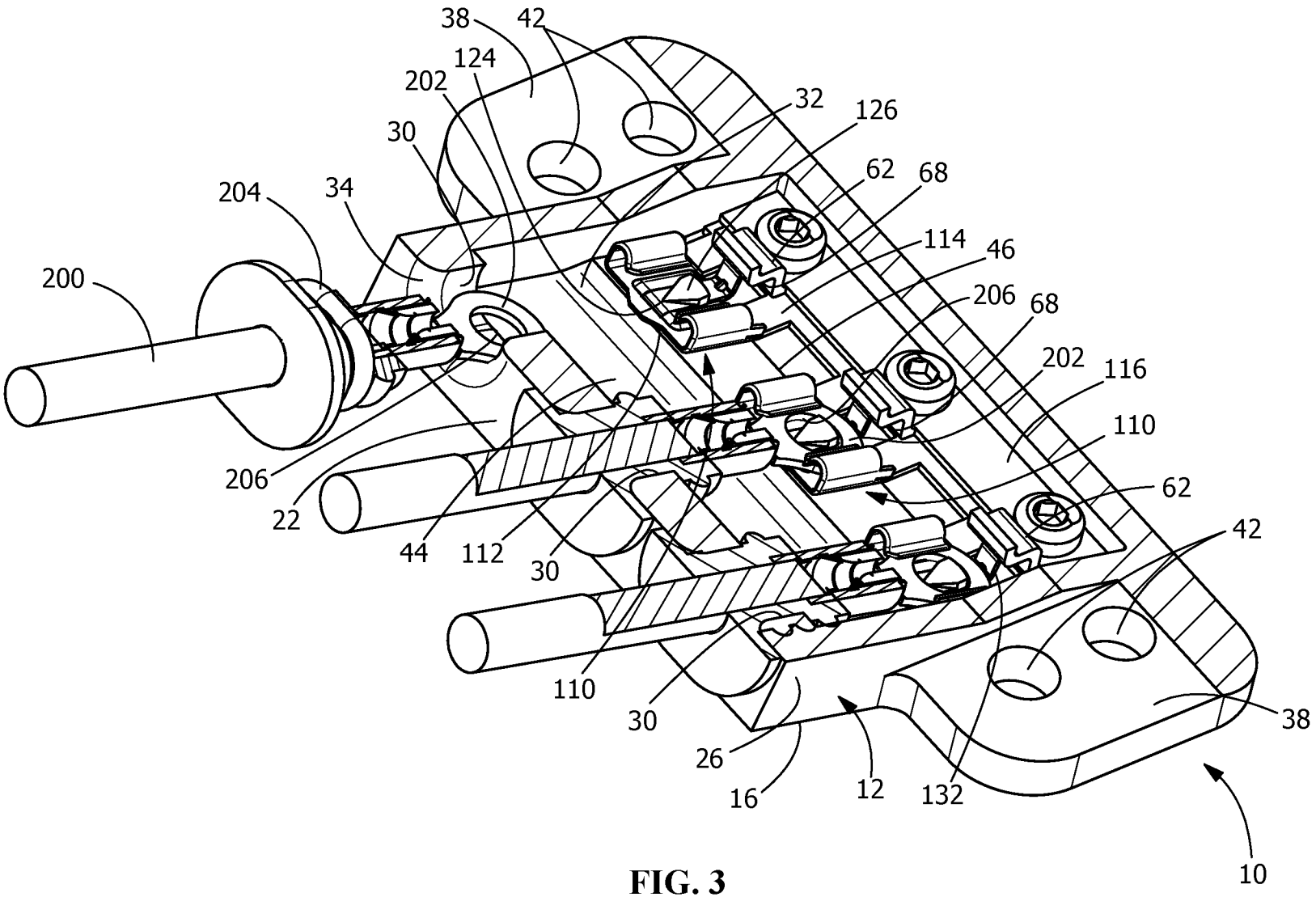
FIG. 3 is a cross-sectional view taken along line 3-3 of FIG. 1.
Figure 6:
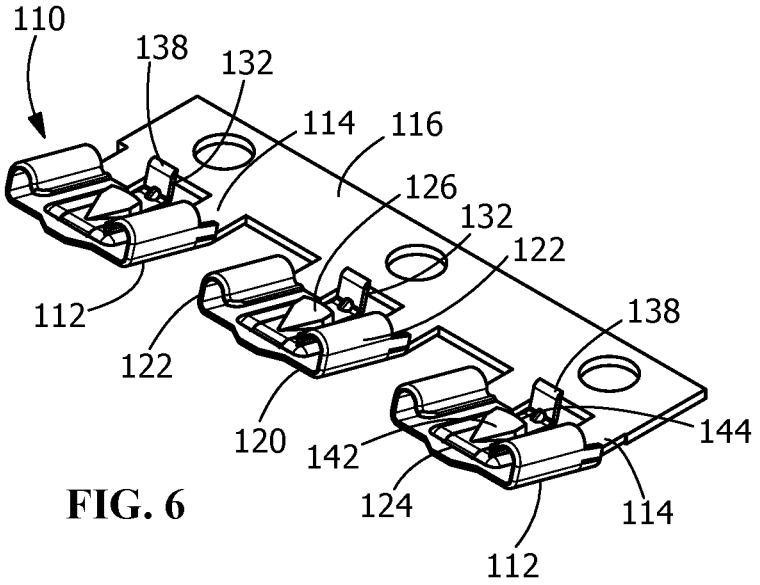
FIG. 6 is a perspective view of an illustrative strip of receptacle terminals prior to insertion into the housing of the connector.
Figure 7:
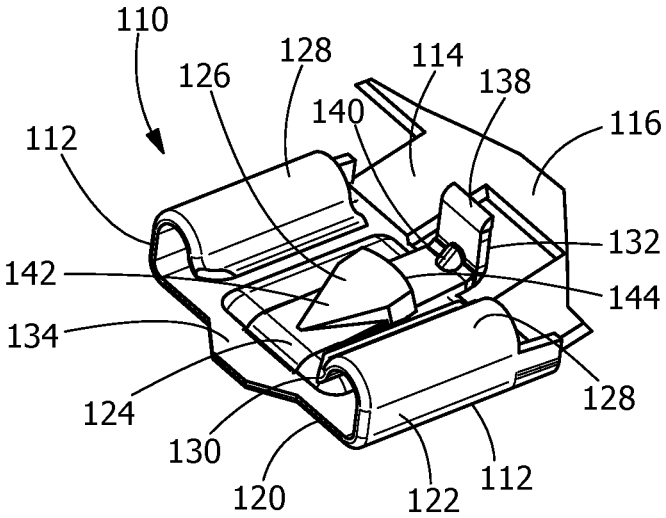
FIG. 7 is an enlarged top perspective view of one of the receptacle terminals of FIG. 6.
Figure 8:
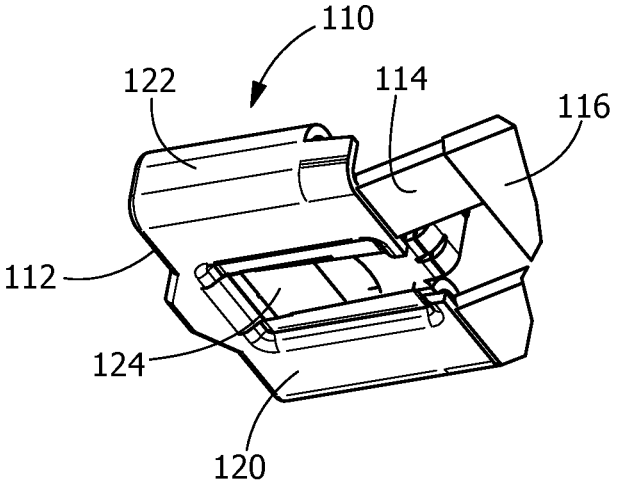
FIG. 8 is an enlarged bottom perspective view of the receptacle terminal of Fla 7.

As shown in FIGS. 3 through 5, a receptacle, socket or female terminal 110 is positioned in the terminal receiving cavity 32. As shown in FIGS. 6 through 8, the receptacle terminals 110 includes a mating portion 112 and a carrier strip engaging portion 114 positioned in line with and behind the mating portion 112. The carrier strip engaging portion 114 extends from, and is electrical engagement with, a carrier strip 116. The carrier strip 116 is provided mechanical and electrical engagement with the substrate by mounting hardware 118 (FIGS. 4 and 5) or other known means. In the illustrative embodiment shown, the terminals 110 and carrier strip 116 are stamped and formed from a metal plate having good electrical conductivity.

As shown in FIGS. 6 through 8, an illustrative embodiment of each of the mating portions 112 includes a bottom wall 120 and resilient contact arms 122 which extend from either side of the bottom wall 120. The bottom wall 120 has a spring arm 124 provided thereon. The spring arm 124 is stamped and formed from the bottom wall 120. While the illustrative embodiment of the mating portion 112 is described, the mating portion 112 may have other configurations. The spring arm 124 is positioned in line with a respective latch release assembly opening 56 and latch release assembly 54.

The spring arm 124 extends from the bottom wall 120 to create a raised portion or arm extending from the inner surface of the bottom wall 120 toward the resilient arms 122. The spring arm 124 includes a latching projection or embossment, such as, but not limited to, a projection, detent, dimple or lance 126 which is formed from the spring arm 124 to create a raised area on an inner surface of the spring arm 124. The latching projection 126 has a lead-in surface 142 and a locking shoulder 144.

The spring arm 124 includes a release projection 132 provided at a free end of the spring arm 124. The release projection 132 extends from the spring arm 124 at essentially a perpendicular direction to the spring arm 124. The release projection 132 has a latch release assembly engagement surface 138 provided at a free end thereof. An embossment 140 (FIG. 7) may be provided between the spring arm 124 and the release projection 132 to provide additional strength to the release projection 132.

As shown in FIG. 6, the resilient arms 122 have arcuate or curled portions 128 which extend from the bottom wall 120 to a mating terminal engaging member 130. In one illustrative embodiment, the resilient arms 122 may have a tapered configuration, whereby the width of the respective arm 122 proximate the bottom wall 120, is greater than the width of the respective arm 122 proximate the mating terminal engaging member 130. However, other configurations can be used. The configuration the resilient contact arms 122 allows the stiffness and spring rate of the resilient contact arms 122 to be controlled. A wider width of the respective arm 122 proximate the bottom wall 120 allows for a higher spring rate and for a more even distribution of forces from the resilient arms 122 to the bottom wall 120. Conversely, a narrow width of the respective arm 122 proximate the bottom wall 120 allows for a lower the spring rate of the resilient contact arms 122.

In the embodiment shown, the mating terminal engaging members 130 extend from the resilient contact arms 122 at the top of a terminal mating slot 134. The configuration of the resilient contact arms 122 provide the resiliency needed to allow the mating terminal engaging member 130 to move relative to the bottom wall 120 as the mating terminal is inserted into the slot 134. The mating terminal engaging members 130 may have an arcuate or rounded configuration. However, other configurations of the mating terminal engaging member 130 may be used.

In the illustrative embodiment shown, the spring arm 124 is stamped and formed from the bottom wall 120. The spring arm 124 is formed to allow a free end 136 thereof to move or be resiliently deformed relative to the bottom wall 120, allowing the spring arm 124 to move toward and away from the mating terminal engaging member 130.

As shown in FIGS. 1 through 5, the connector 10 is configured to mate with conductors or wires 200 with ring tongue terminal lugs 202 crimped to the end thereof. Wire seals 204 are provided on the wires 200. The terminals 202 have a generally circular configuration with a circular opening 206 which extends therethrough. Although the terminals 202 are shown with a circular configuration and circular openings 206, other configuration of the terminals and openings may be used.

In use, the carrier strip 116 and the housing 12 are properly secured to the substrate by means of mounting hardware or other known mounting means. In this position, the gasket 50 cooperates with substrate to provide a seal at the mounting portion 18 of the bottom surface 16 of the housing 12. With the carrier strip 116 and housing 12 properly secured, the wires 200 may be inserted into the terminal receiving cavity 32.

As each of the wires 200 are inserted, the ring tongue terminal 202 are inserted and moved into engagement with the receptacle terminal 110. Continued insertion causes the ring tongue terminal 202 to be inserted in the terminal mating slot 134 of the receptacle terminal 110, causing the ring tongue terminal 202 to engage the mating terminal engagement members 130 and the spring arm 124.

As the ring tongue terminal 202 moved toward it fully inserted position, the ring tongue terminal 202 engages the lead-in surface 142 of the latching projection 126 of the spring arm 124 causing the spring arm 124 to be resiliently deformed downward, away from the mating terminal engagement members 130. Insertion continues until the opening 206 of the ring tongue terminal 202 is moved into alignment with the latching projection 126 of the spring arm 124, allowing the spring arm 124 to return toward it unstressed position. In this position, the latching projection 126 is positioned in and extends through the opening 206.

With the latching projection 126 positioned in the opening 206, the locking shoulder 144 of the latching projection 126 prevents the unwanted removal of the ring tongue terminal 202 and the wire 200. In this position, the ring tongue terminal 202 is provided in electrical engagement with the receptacle terminal 110 by way of the mating terminal engagement members 130 and the spring arm 124. As the receptacle contact 110 is in electrical engagement with the contact strip 116 through the carrier strip engaging portion 114, the ring tongue terminal 202 and the wire 200 are grounded or placed in electrical connection with the substrate.

With the wire 200 properly positioned in the terminal receiving cavity 32, the wire seal 204 is moved into the terminal receiving opening 30 and the terminal receiving cavity 32, as shown in FIGS. 1 through 5. As the wire seal 204 is made from resiliently deformable or compliant material, the wire seal 204 engages the wall of the terminal receiving cavity 32 to seal the terminal receiving cavity 32, as is known in the industry.

If it is desired to remove a wire 200 from the connector 10, the operator depresses membrane 60 from the position shown in FIG. 4 to the position shown in FIG. 5. As the membrane 60 is depressed, the membrane 60 engages the membrane engagement portion 64 of the latch release assembly 54, causing the latch release assembly 54 to be moved or pivoted about the securing portion 66 of the latch release assembly 54. This causes the latch release assembly 54 to be moved from the position shown in FIG. 4 to the position shown in FIG. 5.

As the latch release assembly 54 is moved to the position shown in FIG. 5, the terminal engagement surface 68 engages the latch release assembly engagement surface 138 of the release projection 132 provided on the spring arm 124, causing the latch release assembly engagement surface 138, the release projection 132 and the spring arm 124 to be moved downward to the position shown in FIG. 5.

The movement or depression of the membrane 60 causes the spring arm 124 to be resiliently deformed downward, away from the mating terminal engagement members 130. This causes the locking shoulder 144 and the latching projection 126 to be moved out of the opening 206 of the ring tongue terminal 202. With the locking shoulder 144 and the latching projection 126 removed from the opening 206, the ring tongue terminal 202 may be disengaged from the receptacle terminal 110 and the wire 200 and ring tongue terminal 202 may be removed from the terminal receiving cavity 32 and the connector 10.

The connector 10 provides a strip of receptacle terminals 110 that is electrical and mechanically fixed onto a substrate or other component that needs to be grounded together with whatever is being plugged into this connector. This allows standard ring tongue terminals 202 to be plugged into the connector 10 and electrically connected to the substrate or component that the connector 10 is mounted on. As the receptacle terminals 110 and latching spring arm 124 are located inside the connector 10, the use of the latch release assemblies 54 allows for the release of the ring tongue terminals 202 as needed.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention, including but not limited to, different sized terminals and multiple wire sized. The presently disclosed embodiments are therefore to be considered in all respects as illustrative and not restrictive, the scope of the invention being defined by the appended claims, and not limited to the foregoing description or embodiments.

The invention claimed is:

1. A connector for providing an electrical connection between at least one terminating mating terminal to a substrate, the connector comprising:

a housing having at least one terminal receiving cavity;

a receptacle terminal positioned in the at least one terminal receiving cavity, the receptacle terminal having a latching projection which cooperates with the at least one mating terminal to retain the at least one mating terminal in electrical engagement with the receptacle terminal when the at least one mating terminal is fully inserted in the at least one terminal receiving cavity;

a release mechanism provided in the housing in line with the latching projection of the receptacle terminal, the release mechanism is configured to cooperate with the receptacle terminal to depress the latching projection when the at least one mating terminal is to be removed from the at least one terminal receiving cavity.

2. The connector as recited in claim 1, wherein the housing has a first surface 14 and a second surface, the second surface has a mounting portion for mounting to a substrate.

3. The connector as recited in recited claim 2, wherein a gasket extends about the periphery of the mounting portion of the housing, the gasket is positioned in a gasket receiving cavity, the gasket is configured to cooperate with the substrate to provide a seal between the substrate and the connector.

4. The connector as recited in claim 1, wherein the housing has a front surface with at least one terminal receiving opening which extends to the at least one terminal receiving cavity, the at least one terminal receiving opening having a lead-in surface.

5. The connector as recited in claim 1, wherein the housing has mounting flanges which extend from the side surfaces of the housing, the mounting flanges have bottom surfaces which are coplanar with the mounting portion of the second surface of the housing.

6. The connector as recited in claim 1, wherein the at least one terminal receiving cavity has a wire receiving portion and a receptacle receiving portion, the receptacle receiving portion has a smaller diameter than the wire receiving portion.

7. The connector as recited in claim 1, wherein the receptacle terminal has a mating portion and a carrier strip engaging portion positioned in line with the mating portion, carrier strip engaging portion extends from, and is electrical engagement with, a carrier strip.

8. The connector as recited in claim 1, wherein the carrier strip extends through a contact strip receiving opening in the mounting portion of the second surface of the housing, the contact strip receiving opening extends to each cavity of the at least one terminal receiving cavity.

9. The connector as recited in claim 1, wherein the release mechanism is provided proximate to and extends through a latch release assembly openings provided in the first surface of the housing.

10. The connector as recited in claim 9, wherein the release mechanism has an operator engagement member and receptacle terminal engagement member.

11. The connector as recited in claim 10, wherein the operator engagement member is a membrane.

12. The connector as recited in claim 10, wherein the terminal engagement member has an engagement portion at one end and a securing portion at an opposite end, a terminal engagement surface is provided between the engagement portion and the securing portion.

13. The connector as recited in claim 12, wherein the latching projection is provided on a spring arm of the receptacle terminal.

14. The connector as recited in claim 13, wherein the latching projection has a lead-in surface and a locking shoulder.

15. The connector as recited in claim 14, wherein the spring arm includes a release projection provided at a free end of the spring arm, the release projection is provided in-line with the release mechanism wherein as the release mechanism is depressed, the release mechanism engages the release projection to move the spring arm to a stressed position.

16. The connector as recited in claim 15, wherein the release projection extends from the spring arm at essentially a perpendicular direction to the spring arm, the release projection has release mechanism engagement surface provided at a free end thereof.

17. A connector for providing an electrical connection between at least one terminating ring tongue terminal lug to a substrate, the connector comprising:

a housing having at least one terminal receiving cavity;

a receptacle terminal positioned in the at least one terminal receiving cavity, the receptacle terminal having a spring arm with a latching projection, the latching projection having a locking shoulder, the latching projection and the locking shoulder cooperate with the at least one ring tongue terminal to retain the at least one ring tongue terminal in electrical engagement with the receptacle terminal when the at least one ring tongue terminal is fully inserted in the at least one terminal receiving cavity, the spring arm having a release projection provided at a free end;

a release mechanism provided in the housing in-line with the release projection of the latching projection of the receptacle terminal, the release mechanism being configured to cooperate with the release projection of the latching projection of the receptacle terminal to depress the latching projection when the at least one ring tongue terminal is to be removed from the at least one terminal receiving cavity.

18. The connector as recited in claim 17, wherein the release mechanism is provided proximate to and extends through a latch release assembly openings provided in the first surface of the housing, the release mechanism has an operator engagement member and receptacle terminal engagement member.

19. The connector as recited in claim 18, wherein the terminal engagement member has an engagement portion at one end and a securing portion at an opposite end, a terminal engagement surface is provided between the engagement portion and the securing portion.

20. The connector as recited in claim 18, wherein the release projection extends from the spring arm at essentially a perpendicular direction to the spring arm, the release projection has release mechanism engagement surface provided at a free end thereof.

* * * * *